US008177662B2

(12) United States Patent
Billings

(10) Patent No.: US 8,177,662 B2
(45) **Date of Patent: *May 15, 2012**

(54) GOLF CLUB HEAD WEIGHT WITH SEAL AND VIBRATION DAMPENER

(75) Inventor: David P. Billings, McKinney, TX (US)

(73) Assignee: Dogleg Right Corporation, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/467,139

(22) Filed: Aug. 24, 2006

(65) Prior Publication Data

US 2006/0287127 A1 Dec. 21, 2006

Related U.S. Application Data

(63) Continuation of application No. 11/313,137, filed on Dec. 20, 2005, which is a continuation of application No. 10/043,421, filed on Jan. 10, 2002, now Pat. No. 7,004,852.

(51) Int. Cl.
*A63B 53/04* (2006.01)

(52) U.S. Cl. ..... 473/332; 473/334; 473/335; 473/338; 473/339; 473/349

(58) Field of Classification Search ..... 473/290–292, 473/324–350, 287, 288, 289
See application file for complete search history.

(56) References Cited

U.S. PATENT DOCUMENTS 1,167,106 A 1/1916 Palmer
1,167,387 A * 1/1916 Daniel ..... 473/337
1,213,382 A 1/1917 Kent
1,453,503 A 5/1923 Holmes
1,518,316 A 12/1924 Ellingham
1,526,438 A 2/1925 Scott
1,538,312 A 5/1925 Beat
1,568,888 A 1/1926 Dunn
1,611,110 A * 12/1926 East ..... 473/342
1,756,219 A 4/1930 Spiker
1,868,286 A 7/1932 Grieve
2,067,556 A 1/1937 Wettlaufer
2,163,091 A 6/1939 Held
2,171,383 A 8/1939 Wettlaufer
2,198,981 A 4/1940 Sullivan (Continued)

FOREIGN PATENT DOCUMENTS

JP H6-126004 A 5/1994

(Continued)

OTHER PUBLICATIONS

Taylor Made Golf Company, Inc.; Request for Reexamination of U.S. Pat. No. 7,004,852; Mar. 24, 2008.

(Continued)

*Primary Examiner* — Sebastiano Passaniti
(74) *Attorney, Agent, or Firm* — David H. Judson

(57) ABSTRACT

A metal golf club head that allows a user to customize the location of the center of gravity. The metal golf club head comprises a hollow body with a weighting port. The weighting port allows a user to place weighting material inside the hollow body, customizing the location of the center of gravity, the swing weight, the total weight, and the balance of the golf club.

10 Claims, 4 Drawing Sheets

U.S. PATENT DOCUMENTS

| | | | | | |
|---|---|---|---|---|---|
| 2,214,356 | A | | 9/1940 | Wettlaufer | |
| 2,225,930 | A | | 12/1940 | Sexton | |
| 2,257,575 | A | * | 9/1941 | Reach | 473/338 |
| 2,328,583 | A | | 9/1943 | Reach | |
| 2,332,342 | A | | 10/1943 | Reach | |
| 2,460,445 | A | | 2/1949 | Bigler | |
| 2,998,254 | A | | 8/1961 | Rains et al. | |
| 3,075,768 | A | | 1/1963 | Karns | |
| 3,143,349 | A | | 8/1964 | MacIntyre | |
| 3,466,047 | A | | 9/1969 | Rodia et al. | |
| 3,606,327 | A | | 9/1971 | Gorman | |
| 3,610,630 | A | | 10/1971 | Glover | |
| 3,652,094 | A | | 3/1972 | Glover | |
| 3,680,868 | A | | 8/1972 | Jacob | |
| 3,743,297 | A | * | 7/1973 | Dennis | 473/242 |
| 3,749,408 | A | | 7/1973 | Mills | |
| 3,759,527 | A | * | 9/1973 | Witherspoon | 473/306 |
| 3,897,066 | A | | 7/1975 | Belmont | |
| 3,976,299 | A | | 8/1976 | Lawrence et al. | |
| 3,979,123 | A | | 9/1976 | Belmont | |
| 4,008,896 | A | | 2/1977 | Gordos | |
| 4,043,563 | A | * | 8/1977 | Churchward | 473/338 |
| 4,052,075 | A | * | 10/1977 | Daly | 473/338 |
| 4,085,934 | A | | 4/1978 | Churchward | |
| 4,180,269 | A | | 12/1979 | Thompson | |
| 4,214,754 | A | | 7/1980 | Zebelean | |
| 4,319,752 | A | * | 3/1982 | Thompson | 473/328 |
| 4,325,553 | A | | 4/1982 | Taylor | |
| 4,340,230 | A | | 7/1982 | Churchward | |
| 4,417,731 | A | | 11/1983 | Yamada | |
| 4,423,874 | A | * | 1/1984 | Stuff, Jr. | 473/338 |
| 4,432,549 | A | | 2/1984 | Zebelean | |
| 4,438,931 | A | * | 3/1984 | Motomiya | 473/346 |
| 4,502,687 | A | | 3/1985 | Kochevar | |
| 4,553,755 | A | * | 11/1985 | Yamada | 473/338 |
| 4,607,846 | A | | 8/1986 | Perkins | |
| 4,655,459 | A | | 4/1987 | Antonious | |
| 4,695,054 | A | * | 9/1987 | Tunstall | 473/338 |
| 4,714,577 | A | * | 12/1987 | Nagamoto et al. | 264/46.6 |
| 4,754,977 | A | | 7/1988 | Sahm | |
| 4,811,950 | A | | 3/1989 | Kobayashi | |
| 4,824,116 | A | | 4/1989 | Nagamoto et al. | |
| 4,828,266 | A | * | 5/1989 | Tunstall | 473/336 |
| 4,867,458 | A | | 9/1989 | Sumikawa et al. | |
| 4,869,507 | A | | 9/1989 | Sahm | |
| 4,895,371 | A | | 1/1990 | Bushner | |
| 4,927,144 | A | | 5/1990 | Stormon | |
| 4,944,515 | A | | 7/1990 | Shearer | |
| 5,013,041 | A | | 5/1991 | Sun et al. | |
| 5,050,879 | A | | 9/1991 | Sun et al. | |
| 5,056,705 | A | | 10/1991 | Wakita et al. | |
| 5,058,895 | A | | 10/1991 | Igarashi | |
| 5,064,197 | A | * | 11/1991 | Eddy | 473/326 |
| 5,078,400 | A | | 1/1992 | Desboilles et al. | |
| 5,082,278 | A | | 1/1992 | Hsien | |
| 5,184,823 | A | | 2/1993 | Desboilles et al. | |
| 5,193,806 | A | | 3/1993 | Burkly | |
| 5,219,408 | A | | 6/1993 | Sun | |
| 5,244,210 | A | | 9/1993 | Au | |
| 5,261,664 | A | * | 11/1993 | Anderson | 473/342 |
| 5,273,283 | A | * | 12/1993 | Bowland | 473/338 |
| 5,289,865 | A | | 3/1994 | Sun | |
| 5,299,807 | A | * | 4/1994 | Hutin | 473/329 |
| 5,316,298 | A | | 5/1994 | Hutin et al. | |
| 5,316,305 | A | * | 5/1994 | McCabe | 473/332 |
| 5,322,285 | A | | 6/1994 | Turner | |
| 5,351,958 | A | | 10/1994 | Helmstetter | |
| 5,385,348 | A | | 1/1995 | Wargo | |
| 5,407,202 | A | | 4/1995 | Igarashi | |
| 5,431,396 | A | * | 7/1995 | Shieh | 473/329 |
| 5,447,309 | A | | 9/1995 | Vincent | |
| 5,482,282 | A | | 1/1996 | Willis | |
| 5,518,243 | A | | 5/1996 | Redman | |
| 5,522,593 | A | | 6/1996 | Kobayashi et al. | |
| 5,527,034 | A | | 6/1996 | Ashcraft et al. | |
| 5,533,730 | A | | 7/1996 | Ruvang | |
| 5,558,226 | A | | 9/1996 | Fritz | |
| 5,570,886 | A | | 11/1996 | Rigal et al. | |
| 5,582,553 | A | * | 12/1996 | Ashcraft et al. | 473/345 |
| 5,597,364 | A | * | 1/1997 | Thompson | 473/314 |
| 5,632,694 | A | * | 5/1997 | Lee | 473/336 |
| 5,746,664 | A | | 5/1998 | Reynolds, Jr. | |
| 5,755,624 | A | | 5/1998 | Helmstetter | |
| 5,766,092 | A | | 6/1998 | Mimeur et al. | |
| 5,788,584 | A | * | 8/1998 | Parente et al. | 473/290 |
| 5,797,807 | A | | 8/1998 | Moore | |
| 5,807,187 | A | | 9/1998 | Hamm | |
| D402,341 | S | | 12/1998 | Hamm | |
| 5,851,160 | A | | 12/1998 | Rugge et al. | |
| 5,855,525 | A | | 1/1999 | Turner | |
| 5,863,261 | A | * | 1/1999 | Eggiman | 473/329 |
| 5,911,638 | A | * | 6/1999 | Parente et al. | 473/338 |
| 5,913,735 | A | | 6/1999 | Kenmi | |
| 5,947,840 | A | | 9/1999 | Ryan | |
| 5,961,394 | A | | 10/1999 | Minabe | |
| 5,971,867 | A | * | 10/1999 | Galy | 473/345 |
| 6,001,024 | A | | 12/1999 | Van Alen, II et al. | |
| D419,214 | S | | 1/2000 | Hamm | |
| 6,015,354 | A | | 1/2000 | Ahn et al. | |
| 6,030,295 | A | | 2/2000 | Takeda | |
| 6,033,318 | A | * | 3/2000 | Drajan et al. | 473/309 |
| 6,089,994 | A | | 7/2000 | Sun | |
| 6,102,813 | A | | 8/2000 | Dill | |
| 6,206,790 | B1 | | 3/2001 | Kubica et al. | |
| 6,248,025 | B1 | | 6/2001 | Murphy et al. | |
| 6,254,494 | B1 | | 7/2001 | Hasebe et al. | |
| 6,290,609 | B1 | | 9/2001 | Takeda | |
| 6,306,048 | B1 | | 10/2001 | McCabe et al. | |
| 6,309,311 | B1 | | 10/2001 | Lu | |
| 6,315,678 | B1 | | 11/2001 | Teramoto | |
| 6,354,962 | B1 | | 3/2002 | Galloway et al. | |
| 6,364,788 | B1 | | 4/2002 | Helmstetter et al. | |
| 6,443,851 | B1 | | 9/2002 | Liberatore | |
| 6,458,044 | B1 | | 10/2002 | Vincent et al. | |
| 6,475,101 | B2 | | 11/2002 | Burrows | |
| 6,491,592 | B2 | | 12/2002 | Cackett | |
| 6,514,154 | B1 | | 2/2003 | Finn | |
| 6,530,848 | B2 | | 3/2003 | Gillig | |
| 6,592,468 | B2 | * | 7/2003 | Vincent et al. | 473/334 |
| 6,648,772 | B2 | | 11/2003 | Vincent et al. | |
| 6,716,111 | B2 | | 4/2004 | Liberatore | |
| 6,902,495 | B2 | * | 6/2005 | Pergande et al. | 473/332 |
| 6,923,734 | B2 | | 8/2005 | Meyer | |
| 6,991,558 | B2 | | 1/2006 | Beach et al. | |
| 7,004,852 | B2 | * | 2/2006 | Billings | 473/332 |
| 7,108,609 | B2 | * | 9/2006 | Stites et al. | 473/256 |
| D529,972 | S | | 10/2006 | Hamm | |
| 7,147,570 | B2 | | 12/2006 | Toulon et al. | |
| 7,147,573 | B2 | | 12/2006 | DiMarco | |
| 7,166,041 | B2 | | 1/2007 | Evans | |
| 7,189,169 | B2 | * | 3/2007 | Billings | 473/332 |
| 7,198,575 | B2 | | 4/2007 | Beach et al. | |
| 7,344,450 | B2 | * | 3/2008 | Billings | 473/324 |
| D592,720 | S | | 5/2009 | Hamm | |
| 7,828,672 | B2 | * | 11/2010 | Billings | 473/332 |
| 2002/0065144 | A1 | * | 5/2002 | Helmstetter et al. | 473/332 |
| 2002/0128089 | A1 | | 9/2002 | Sillers et al. | |
| 2002/0137576 | A1 | | 9/2002 | Dammen | |
| 2006/0166757 | A1 | * | 7/2006 | Butler et al. | 473/334 |

FOREIGN PATENT DOCUMENTS

| | | | |
|---|---|---|---|
| JP | H7-15067 | A | 3/1995 |
| JP | H11-9742 | A | 1/1999 |
| JP | 2000-24149 | A | 1/2000 |
| WO | WO 01/66199 | A1 | 9/2001 |

OTHER PUBLICATIONS

Taylor Made Golf Company, Inc.; Request for Reexamination of U.S. Pat. No. 7,189,169; Mar. 24, 2008.

Edwin Watts Golf, Fathers Day 2003 catalog, p. 40.

Complaint; Dogleg Right Partners LP, Dogleg Right Corporation; Civil Action No. 2:07-CV-533-TJW/CE; Dec. 7, 2007.

Taylor Made's Answer to Complaint for Patent Infringement, Counterclaim; Taylor Made Golf Company; Civil Action No. 2:07-CV-533-TJW/CE; Jan. 25, 2008.

Answer to Taylor Made's Counterclaims; Dogleg Right Partners LP, Dogleg Right Corporation; Civil Action No. 2:07-CV-533-TJW/CE; (5 pages) Feb. 14, 2008.
Motion for Leave to File Amend Pleadings; Dogleg Right Partners LP, Dogleg Right Corporation; Civil Action No. 2:07-CV-533-TJW/CE; (40 pages) Mar. 28, 2008.
First Amended Complaint; Dogleg Right Partners LP, Dogleg Right Corporation; Civil Action No. 2:07-CV-533-TJW/CE; (34 pages) Aug. 26, 2008.
Discovery Order; Civil Action No. 2:07-CV-533-TJW/CE; (7 pages) Aug. 15, 2008.
Docket Control Order; Civil Action No. 2:07-CV-533-TJW/CE; (4 pages) Aug. 15, 2008.
Order Granting Motion for Extension of Time; Civil Action No. 2:07-CV-533-TJW/CE; (1 page) Sep. 9, 2008.
Notice of Disclosure by DLRP and DLRC; Dogleg Right Partners LP, Dogleg Right Corporation; Civil Action No. 2:07-CV-533-TJW/CE; (3 pages) Sep. 22, 2008.
Plaintiff's Initial Disclosures; Dogleg Right Partners LP, Dogleg Right Corporation; Civil Action No. 2:07-CV-533-TJW/CE; (4 pages) Sep. 22, 2008.
Agreed Protective Order; Dogleg Right Partners LP, Dogleg Right Corporation; Civil Action No. 2:07-CV-533-TJW/CE; (16 pages) Sep. 23, 2008.
Notice of Disclosure by TMaG; TaylorMade Golf Company; Civil Action No. 2:07-CV-533-TJW/CE; (2 pages) Sep. 23, 2008.
Initial Disclosures, TaylorMade Golf Company, Civil Action No. 2:07-CV-533-TJW/CE; (11 pages) Sep. 23, 2008.
Answer to Amended Complaint; TaylorMade Golf Company; Civil Action No. 2:07-CV-533-TJW/CE; (15 pages) Sep. 24, 2008.
Notice of Disclosure by DLRP and DLRC; Dogleg Right Partners LP, Dogleg Right Corporation; Civil Action No. 2:07-CV-533-TJW/CE; (3 pages) Oct. 7, 2008.
Plaintiffs' Disclosure of Asserted Claims and Infringement Contentions with Exhibits; Dogleg Right Partners LP, Dogleg Right Corporation; Civil Action No. 2:07-CV-533-TJW/CE; (476 pages) Oct. 7, 2008.
Plaintiffs' Document Production Accompanying Disclosures with documents disclosed; Dogleg Right Partners LP, Dogleg Right Corporation; Civil Action No. 2:07-CV-533-TJW/CE; (625 pages) Oct. 7, 2008.
Answer to Answer to Amended Complaint; Dogleg Right Partners LP, Dogleg Right Corporation; Civil Action No. 2:07-CV-533-TJW/CE; (5 pages) Oct. 13, 2009.
Order Granting Motion for Extension of Time; Civil Action No. 2:07-CV-533-TJW/CE; (1 page) Oct. 23, 2008.
Invalidity Contentions and Production Documents; TaylorMade Golf Company; Civil Action No. 2:07-CV-533-TJW/CE; (133 pages) Nov. 21, 2008.
Unopposed Motion for Leave to File Supplemental Infringement Contentions; Dogleg Right Partners LP, Dogleg Right Corporation; Civil Action No. 2:07-CV-533-TJW/CE; (59 pages) Apr. 1, 2009.
Order Granting Motion for Leave to File Supplemental Infringement Contentions; Civil Action No. 2:07-CV-533-TJW/CE; (1 page) Apr. 3, 2009.
Order Granting Motion for Extension of Time to Complete Discovery; Civil Action No. 2:07-CV-533-TJW/CE; (1 page) Apr. 21, 2009.
U.S. Control No. 95/000,361; Order Granting *Inter Partes* Reexamination of US Pat. No. 7,004,852 and First Office Action; Jun. 19, 2008.
U.S. Control No. 95/000,361; Patent Owner's Response; Sep. 19, 2008.
U.S. Control No. 95/000,361; Third Party Requestor's Comments with Declaration of Benoit Vincent; Oct. 20, 2008.
U.S. Control No. 95/000,361; Office Action; Jun. 8, 2009.
U.S. Control No. 95/000,361; Patent Owner's Response, with Declaration of Richard Parente, and Supplemental Declaration of Peter Piotrowski; Aug. 10, 2009.
U.S. Control No. 95/000,361; Third Party Requestor's Comments and Supplemental Declaration of Benoit Vincent; Sep. 9, 2009.
U.S. Control No. 95/000,362; Order Granting *Inter Partes* Reexamination of US Pat. No. 7,189,169 and First Office Action; Jun. 19, 2008.
U.S. Control No. 95/000,362; Patent Owner's Response; Sep. 19, 2008.
U.S. Control No. 95/000,362; Third Party Requestor's Comments with Declaration of Benoit Vincent; Oct. 20, 2008.
U.S. Control No. 95/000,362; Office Action; Jun. 8, 2009.
U.S. Control No. 95/000,362; Patent Owner's Response, with Declaration of Richard Parente, and Supplemental Declaration of Peter Piotrowski; Aug. 10, 2009.
U.S. Control No. 95/000,362; Third Party Requestor's Comments and Supplemental Declaration of Benoit Vincent; Sep. 9, 2009.
Taylor Made Golf Company, Inc.; Request for Reexamination of US Patent No. 7,344,450 with Notice of Litigation and Supplemental Information Disclosure Statement; Jun. 19, 2008.
U.S. Control No. 95/000,378; PTO Decision Vacating Filing Date of *Inter Partes* Reexamination of US Pat. No. 7,344,450; Sep. 4, 2008.
U.S. Control No. 95/000,378; Taylor Made Golf Company, Inc.; Corrected Request for Reexamination of US Patent No. 7,344,450; Oct. 6, 2008.
U.S. Control No. 95/000,378; Order Granting *Inter Partes* Reexamination of US Pat. No. 7,344,450; Dec. 19, 2008.
U.S. Control No. 95/000,378; Office Action in *Inter Partes* Reexamination of US Pat. No. 7,344,450; Mar. 25, 2009.
U.S. Control No. 95/000,378; Patent Owner's Response with Declaration of Richard Parente, and Declaration of Peter Piotrowski: Jul. 2, 2009.
U.S. Control No. 95/000,378; Third Party Requestor's Comments and Information Disclosure Statement; Aug. 11, 2009.
U.S. Control No. 95/000,378; Declaration of Benoit Vincent; Jul. 31, 2009.
Burrows, Bruce D.; "Metal Wood Golf Club Head With Faceplate Insert"; U.S. Appl. No. 60/218,731, filed Jul. 17, 2000.
Burrows, Bruce D.; "Metal Wood Golf Club Head With Faceplate Insert"; U.S. Appl. No. 60/286,323, filed Apr. 24, 2001.
U.S. Control No. 95/000,378; Third Party Requestor's Petition with Declarations of B. Agness and B. Rodriguez; Aug. 11, 2009.
U.S. Control No. 95/000,378; Decision on Petition; Aug. 25, 2009.
U.S. Control No. 95/000,378; Request for Reconsideration of Petition; Aug. 31, 2009.
U.S. Control No. 95/000,378; Decision on Petition; Oct. 7, 2009.
U.S. Control No. 95/000,378; Third Party Requestor's Petition Under 37 C.F.R. 1.182; Oct. 13, 2009.
U.S. Control No. 95/000,378; Third Party Requestor's Petition Under 37 C.F.R. 1.183; Oct. 13, 2009.
U.S. Appl. No. 10/043,421; Office Action with Notice of References Cited; Nov. 1, 2002.
U.S. Appl. No. 10/043,421; Amendment; May 6, 2003.
U.S. Appl. No. 10/043,421; Office Action (Final); Jul. 24, 2003.
U.S. Appl. No. 10/043,421; Amendment After Final with RCE; Jan. 5, 2004.
U.S. Appl. No. 10/043,421; Office Action with Notice of References Cited; Feb. 12, 2004.
U.S. Appl. No. 10/043,421; Amendment; Jul. 15, 2004.
U.S. Appl. No. 10/043,421; Office Action (Final) with Notice of References Cited; Nov. 18, 2004.
U.S. Appl. No. 10/043,421; Amendment After Final with RCE; Apr. 22, 2005.
U.S. Appl. No. 10/043,421; Office Action; May 20, 2005.
U.S. Appl. No. 10/043,421; Amendment; Sep. 12, 2005.
U.S. Appl. No. 11/313,137; Petition to Make Special; Feb. 20, 2006.
U.S. Appl. No. 11/313,137; Office Action with Notice of References Cited; Jul. 14, 2006.
U.S. Appl. No. 11/313,137; Proposed Amendment; Aug. 11, 2006.
U.S. Appl. No. 11/313,137; Examiner's Interview Summary; Aug. 16, 2006.
U.S. Appl. No. 11/313,137; Amendment; Aug. 15, 2006.
U.S. Appl. No. 11/313,137; Office Action; Oct. 31, 2006.
U.S. Appl. No. 11/313,137 Amendment; Nov. 29, 2006.
U.S. Appl. No. 11/313,137; Notice of Allowance, Notice of Allowability and Examiner's Interview Summary; Dec. 15, 2006.
U.S. Appl. No. 11/467,136; Petition to Make Special; Aug. 24, 2006.
U.S. Appl. No. 11/467,136; Office Action with Notice of References Cited; May 29, 2007.
U.S. Appl. No. 11/467,136; Amendment; Nov. 29, 2007.

U.S. Appl. No. 11/467,136; Supplemental Amendment; Dec. 13, 2007.
U.S. Appl. No. 11/467,136; Notice of Allowance and Examiner's Interview Summary; Jan. 11, 2008.
U.S. Appl. No. 11/467,142 Petition to Make Special; Aug. 24, 2006.
U.S. Appl. No. 11/467,142; Office Action; Mar. 8, 2007.
U.S. Appl. No. 11/467,142; Amendment; Sep. 10, 2007.
U.S. Appl. No. 11/467,142; Office Action; Nov. 21, 2007.
U.S. Appl. No. 11/467,142; Amendment; May 21, 2008.
U.S. Appl. No. 11/467,142; Office Action; Aug. 4, 2008.
U.S. Appl. No. 11/467,142; Amendment; Feb. 4, 2009.
U.S. Appl. No. 11/467,142; Final Office Action; Apr. 19, 2009.
U.S. Appl. No. 11/467,142; Response; Oct. 15, 2009.
"Zolex Hammer Driver: Add 50 Yards to Your Tee Shot!"; web page; https://www.hammergolfshop.com/ ; 2009.
USGA United States Golf Association; "Procedure for Measuring the Flexibility of a Golf Clubhead, Revision 2.0"; Mar. 25, 2005.
USGA United States Golf Association; "The Rules of Golf" Appendix II, "5. Club Face"; p. 135; United States Golf Association, 2007.
Wikipedia; "Thin-shell structure"; http://en.wikipedia.org/wiki/Thin-shell_structure; Wikimedia Foundation, Inc., 2009.
FORGING.ORG; "4.3 Aluminum Alloys"; http://www.forging.org/Design/pg4_3.html, 2009.
SUBSTECH.COM; Wrought aluminum-zinc-magnesium alloy 7075 [SubsTech]; http://www.substech.com/dokuwiki/doku.php?id=wrought_aluminum-zinc-magnesium_alloy_7075, 2009.
SUBSTECH.COM; Wrought aluminum-magnesium-silicon alloy 6061 [SubsTech]; http://www.substech.com/dokuwiki/doku.php?id=wrought_aluminum-magnesium-silicon_alloy_6061, 2009.
Wikipedia; "7075 aluminum"; http://en.wikipedia.org/wiki/7075_aluminum; Wikimedia Foundation, Inc., 2008.
Wikipedia; "6061 aluminum"; http://en.wikipedia.org/wiki/6061_aluminum; Wikimedia Foundation, Inc., 2008.
Wikipedia; "Yield (engineering)"; http://en.wikipedia.org/wiki/Yield_(engineering); Wikimedia Foundation, Inc., 2008.
Goldwin Golf, "Driver 11 Standard Milled Metal Wood driver", 14 photographs (admitted prior art).
XFACTORDIRECT.COM; "Hammer—The World's Longest Driver, Hammer Home"; webpage, http://www.xfactordirect.com/home.htm ; 2009.
XFACTORDIRECT.COM; "HammerX—The World's Longest Driver"; webpage, http://www.xfactordirect.com/home.htm ; 2009.
XFACTORDIRECT.COM; "New XShaft"; webpage, http://www.xfactordirect.com/home.htm ; 2009.
XFACTORDIRECT.COM; "Zolex Hammer"; webpage, http://www.xfactordirect.com/home.htm ; 2009.
XFACTORDIRECT.COM; "AirXtreme Xplosion drivers"; webpage, http://www.xfactordirect.com/home.htm ; 2009.
XFACTORDIRECT.COM; "HammerPutter"; webpage, http://www.xfactordirect.com/home.htm ; 2009.

* cited by examiner

GOLF CLUB HEAD WEIGHT WITH SEAL AND VIBRATION DAMPENER

CROSS-REFERENCE TO RELATED APPLICATIONS

This application is a continuation of, and claims the benefit of the filing date of, co-pending U.S. patent application Ser. No. 11/313,137 entitled CUSTOMIZABLE CENTER-OF-GRAVITY GOLF CLUB HEAD, filed Dec. 20, 2005, which is a continuation of U.S. patent application Ser. No. 10/043,421 entitled CUSTOMIZABLE CENTER-OF-GRAVITY GOLF CLUB HEAD, filed Jan. 10, 2002, now U.S. Pat. No. 7,004,852.

BACKGROUND OF THE INVENTION

1. Field of the Invention

The invention relates generally to golf clubs and, more particularly, to a golf club head in which the center of gravity, balance, and weight are customizable and can be altered to suit changing course conditions, weather conditions, and/or other user requirements.

2. Description of Related Art

Golfers have long recognized that they could alter the weight, balance, and performance characteristics by selectively adding weight to club heads. Typically, weight is added by applying thin strips of lead tape with an adhesive backing to the club head. In this manner the swing weight is increased and the center of gravity (CG) is altered to change the dynamics of the head during the swing and, therefore, the ball flight characteristics after contact. The location of the lead tape, however, is generally limited to the back, crown, and/or sole of the club heads where it would best stay affixed and not alter the look of the club, but this limits the adjustability options available to the golfer. For example, the lead tape could not be put on the face of the club to move the CG closer to the front of the club which is more desirable to some golfers who want the club to be easier to "work", i.e., to shape shots both in a left-to-right manner and in a right-to-left manner.

Furthermore, this use of lead tape was generally an additive process whereby the swing weight and total weight of the club was increased, often times negatively effecting other performance characteristics of the club. Some golfers overcame this obstacle by grinding down or using other means to reduce the weight of the club. However, this often damaged the protective finish of the club or the shape and configuration intended by the club designer, negatively effected the after market value of the club, and was difficult and time consuming for the golfer to adjust.

Furthermore, manufacturers of golf clubs have encountered problems when attempting to manufacture individual clubs to identical specifications because of variances of the individual components themselves and when assembled together. Generally, manufacturers build clubs to a weight at, or slightly below, a targeted weight specification and then add additional weight in the head and/or the shaft to increase the total weight and/or the swing weight to the desired specification. Additional weight is commonly added by pouring lead powder into the bottom of the shaft and sealing the shaft with a cork or other means. Alternatively, lead powder has been mixed with putty, epoxy, or other materials that are inserted into the end of the shaft of the assembled head and shaft to facilitate this final weight adjustment by the manufacturer. This method, however, alters the CG of the club away from the optimal location, adversely effecting performance and feel.

Additionally, a common practice has been to inject a hot melt glue or similar material into a hole in the club head during final assembly to arrive at a prescribed swing weight. The location that the glue puddles and adheres to the inner walls is determined by the orientation of the head while the glue is still hot and fluid. Furthermore, this technique has been used to customize the center of gravity of the club head for specific golfers' needs. The location of the glue, however, is generally limited to one broad area due to the closed process, and once the glue is set, the glue is not adjustable.

Several methods have been attempted to create a golf club that allows the weight, balance, and CG of golf club heads to be altered. One example is disclosed in U.S. Pat. No. 6,254,494 to Hasebe, et al. (hereinafter "Hasebe"), entitled, "Golf club head". The weights, which effect CG location and club head dynamics during the swing and the ball flight after contact, can be changed during manufacturing. Once manufactured, however, the weights can not be altered or be customized for individual needs. Therefore, a club head must be manufactured for each desired weighting configuration.

Another example is disclosed in U.S. Pat. No. 6,248,025 to Murphy, et al. (hereinafter "Murphy"), entitled, "Composite golf club head and method of manufacturing". Murphy discloses a weight strip within a ribbon of the body of the club head. Weights in the form of densified loaded films and/or ribbons of material denser than the primary composite material of the head are added to the internal structure to assertedly increase the forgiveness and playability characteristics, including the energy transfer. Murphy discloses that the location and configuration of the weights can be changed during manufacture to achieve varying characteristics, but, once the weights are added and the club head is completed in manufacturing, the weights can not be altered.

Yet another example is disclosed in U.S. Pat. No. 6,206,790 by Kubica, et al. (hereinafter "Kubica"), entitled "Iron type golf club head with weight adjustment member". Kubica assertedly discloses a weight adjustment member located within a secondary cavity within the back of a cavity back iron golf club head. The weight adjustment member is said to be chosen from a plurality of weight adjustment members to overcome variances in manufacturing tolerances and to adjust golf club swing weights to custom fit various golfers' requirements. The weight adjustment member, however, does not allow the position of the CG to be altered.

Yet still another example is disclosed in U.S. Pat. No. 3,652,094, to Glover (hereinafter "Glover"), entitled, "Golf club with adjustable weighting plugs". Glover assertedly discloses the use of threaded weight plugs to alter the CG. The location of the CG in Glover, however, is limited to the position of the threaded cavities. Similarly, U.S. Pat. No. 5,050,879 to Sun, et al. (hereinafter "Sun"), entitled, "Golf driver with variable weighting for changing center of gravity", assertedly discloses three cavities that are sealed by a cover plate in the sole where weight members can be selectively installed. However, the user's options for the location of the weight members is limited to adjustment between the three predetermined cavities, in the horizontal plane from heel to toe, and near the sole only.

Yet still another example is disclosed in U.S. Pat. No. 6,306,048 to McCabe, et al. (hereinafter "McCabe"), entitled, "Golf club with weight adjustment". McCabe assertedly discloses one or more weight chambers that the golfer uses to adjust the weight and CG of a club to customize it to his or her own needs. A filler material is used to set the weights in position. This method, however, limits the weights and weight changes to the location of the internal weight chamber, and, once the filler material is set, the golfer can no longer adjust the weight or center of gravity.

Therefore, there is a need for a golf club head with a customizable CG that allows the CG to be altered by a golfer and/or the manufacturer.

SUMMARY

The present invention provides a metal golf club head that allows a user to customize the location of the center of gravity. The metal golf club head comprises hollow-body golf club head with a weighting port that allows the user to access the interior of the hollow-body golf club head. The weighting port allows a user to place weighting material, such as lead tape and the like, inside the golf club head, thereby customizing the location of the center of gravity.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION

Figure 1:
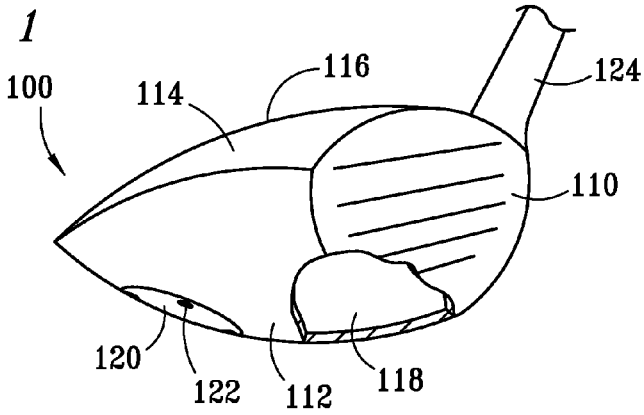
FIG. 1 illustrates a metal golf club head that embodies features of the present invention.
Figure 3:
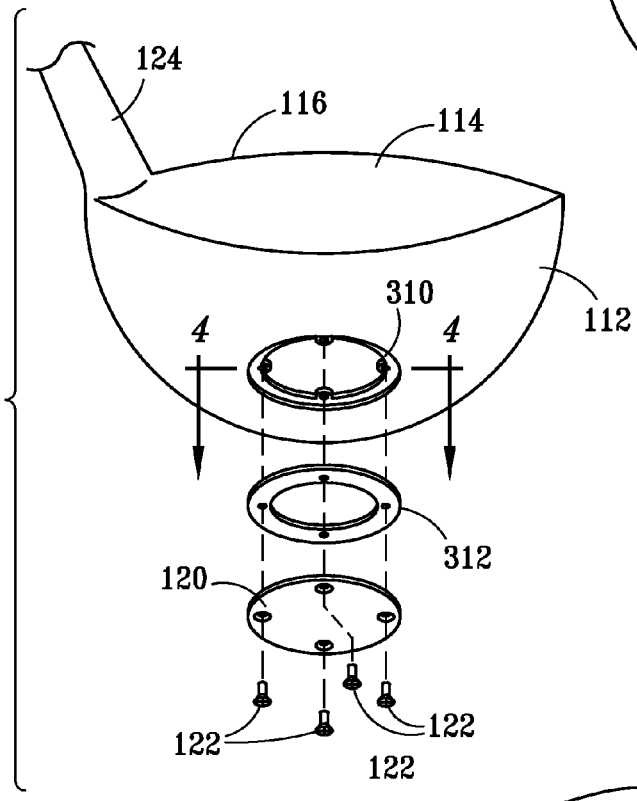
FIG. 3 illustrates a rear view of a metal golf club head with a weighting port cover removed that embodies features of the present invention.

Referring to FIG. 1 of the drawings, the reference numeral 100 generally designates a hollow golf club head embodying features of the present invention. The hollow golf club head 100 generally comprises a face portion 110, an integrated sole and wall portion 112, and a crown portion 114 defining a body 116 with an interior cavity 118. A hosel portion 124 is connected to and/or integrated into the body 116 for receiving a shaft (not shown). Furthermore, a removable, port cover 120, which is described in further detail below with reference to FIG. 3, provides access to the interior cavity 118, thereby allowing the placement of weighting material, such as lead tape, into the interior cavity 118.

In the preferred embodiment, the hollow golf club head 100 comprises a two-piece golf club head. The first piece comprising the integrated sole and wall portion 112 and the face portion 110, including the hosel portion 124. The second piece comprises the crown portion 114, which is welded or otherwise attached to the first piece. Other embodiments, such as a three-piece golf club head, however, may be used as is known in the art.

Figure 2:
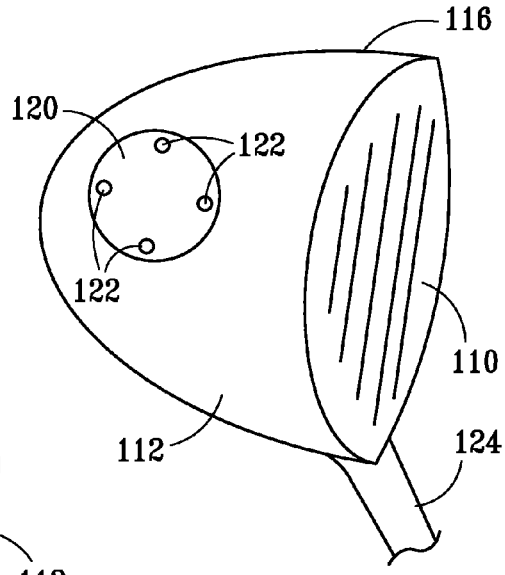
FIG. 2 illustrates a bottom view of a metal golf club head that embodies features of the present invention.

FIG. 2 is a bottom view of the hollow golf club head 100, further illustrating the positioning and sizing of the weighting-port cover 120 in the preferred embodiment. Preferably, the weighting-port cover 120 is positioned on the bottom, i.e., the sole, of the hollow golf club head 100 and away from the face portion 110. Therefore, the weighting-port cover 120 is preferably positioned such that the weighting-port cover 120 is not visible by a golfer when addressing a golf ball. Furthermore, the placement of the weighting-port cover 120 away from the face portion 110 allows placement of weighting material about, or on, the interior side of the face portion 110, and along the heal/toe portions of the hollow golf club head 100, as will be described in greater detail below with reference to FIG. 4.

The weighting port cover 120 is preferably attached to the body 116 via a plurality of flush-mounted bolts 122, and, optionally, may be coated with a friction-reducing material, such as Teflon. In order to reduce the friction, the possibility of the weighting-port cover to "snag" onto grass, thereby affecting the swing path, and the wear and tear, the weighting-port cover 120 is flush-mounted to the integrated sole and wall portion 112 by the plurality of flush-mounted bolts 122.

FIG. 3 illustrates the hollow golf club head 100 with the weighting-port cover 120 removed. The body 116 preferably includes a recessed portion 310 configured for receiving an optional vibration-dampening ring 312 and the weighting-port cover 120. The vibration-dampening ring 312, such as a ring made from foam, rubber, and/or the like, allows the weighting-port cover 120 to be securely fastened, preventing a vibration/rattling noise that may occur as a result of swinging the club and/or striking a ball and sealing the interior cavity from exposure to outside elements, such as sand, water, and/or the like.

The plurality of flush-mounted bolts 122 pass through the weighting-port cover 120 and screw into the recessed portion 310 of the body 116. Alternatively, other methods, such as a weighting-port cover that screws into the body 116, latches, press-fits, or the like, may be used. The preferred embodiment, however, allows for weighting-port cover 120 that is curved to match the contour of the body.

Figure 4:
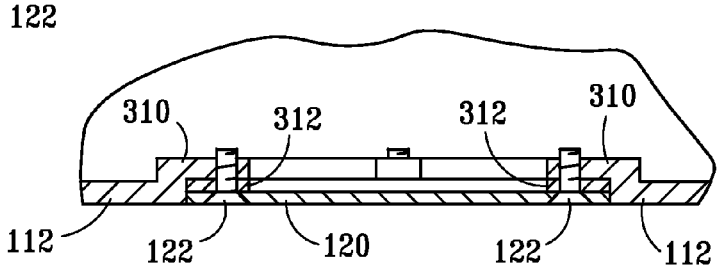
FIG. 4 illustrates a cross-section view with the weighting port cover attached that embodies features of the present invention.

FIG. 4 illustrates a side view of the weighting-port cover 120 attached to the body 116 in accordance the one embodiment of the present invention depicted in FIG. 3. As one skilled in the art will appreciate, the recessed portion 310 allows a smooth contour to be formed by the integrated sole and wall portion 112 and the weighting-port cover 120 when assembled. In an alternative embodiment, however, the weighting-port cover 120 is recessed from the integrated sole and wall portion.

Figure 5:
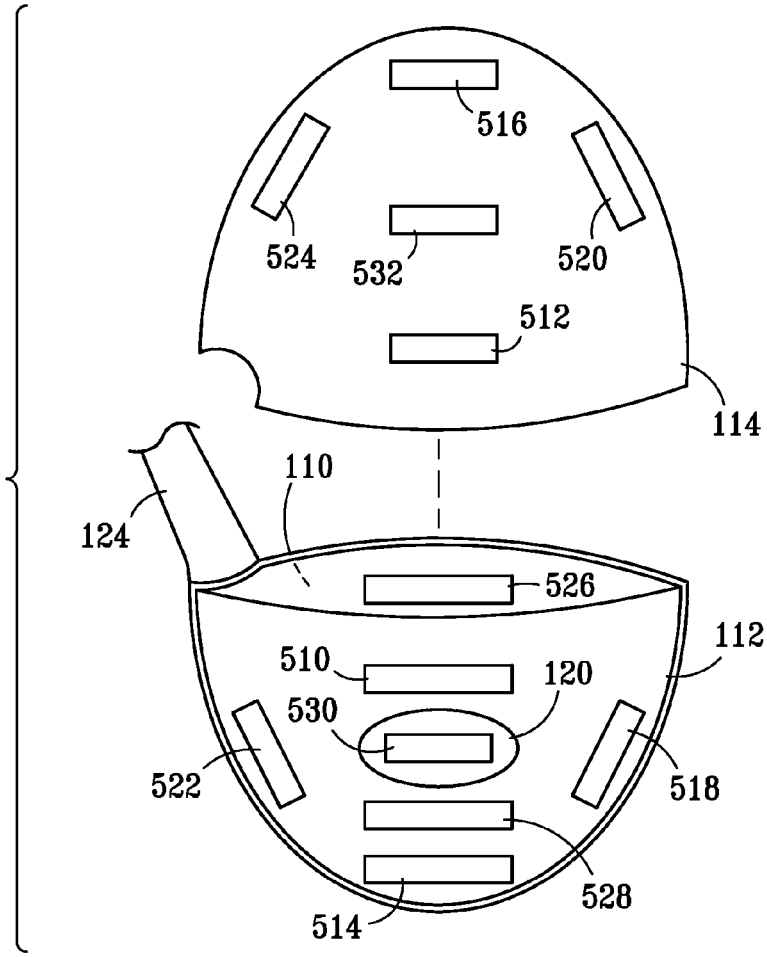
FIG. 5 illustrates a metal golf club head with the crown portion removed to indicate some positions of weighting material.

FIG. 5 illustrates the hollow golf club head 100 with the crown portion 114 separated from the integrated sole and wall portion 112 in order to illustrate potential placements of weighting material in accordance with embodiments of the present invention. The illustrated positions are presented for illustrative purposes only and, therefore, should not limit the present invention in any manner. Furthermore, the positions may be used individually or in combination to further customize the location of the center of gravity.

Weight location 510 illustrates a low-front-center location, which is located on the integrated sole and wall portion 112 adjacent to the face portion 110, that imparts less spin on the ball and a high trajectory, resulting in easier workability (the ability to hit the ball from left to right and vice versa) and more carry (the distance the ball travels in the air).

Weight location 512 illustrates a high-front-center location, which is located on the crown portion 114 adjacent to the face portion, that imparts less spin on the ball and a low trajectory, resulting in easier workability, less carry, and more rolling.

Weight location 514 illustrates a low-back-center location, which is located on the back-center of the integrated sole and wall portion 112, that results in more forgiveness and a high trajectory.

Weight location 516 illustrates a high-back-center location, which is located on the back-center of the crown portion 114, that results in more forgiveness and a low trajectory.

Weight location 518 illustrates a low-back-toe location, which is located on the back-center of the integrated sole and wall portion 112 along the toe, that results in more forgiveness and a high, fading trajectory.

Weight location 520 illustrates a high-back-toe location, which is located on the back-center of the crown portion 114 along the toe, that results in more forgiveness and a low, fading trajectory.

Weight location 522 illustrates a low-back-heel location, which is located on the back-center of the integrated sole and wall portion 112 along the heel, that results in more forgiveness and a high, drawing trajectory.

Weight location 524 illustrates a high-back-heel location, which is located on the back-center of the crown portion 114 along the heel, that results in more forgiveness and a low, drawing trajectory.

Weight location 526 illustrates a forward-center-center location, which is located on the center of the face portion 110, that results in easier workability with a neutral trajectory.

Weight location 528 illustrates a back-center-center location, which is located in the vertical-center of the integrated sole and wall portion 112, that results in neutrally forgiving club head.

Weight location 530 illustrates a low-center-center location, which is located on the center of the integrated sole and wall portion 112, that results in a neutral side-spin with a high trajectory. Note that this location is located on the weighting-port cover 120 for illustrative purposes only. As stated above, the weighting-port cover 120 may be located at any desired location, and a weight may be placed on the weighting-port cover 120 if so desired.

Weight location 532 illustrates a high-center-center location, which is located in the center of the crown portion 114, that results in a neutral side-spin with a low trajectory.

Figure 6:
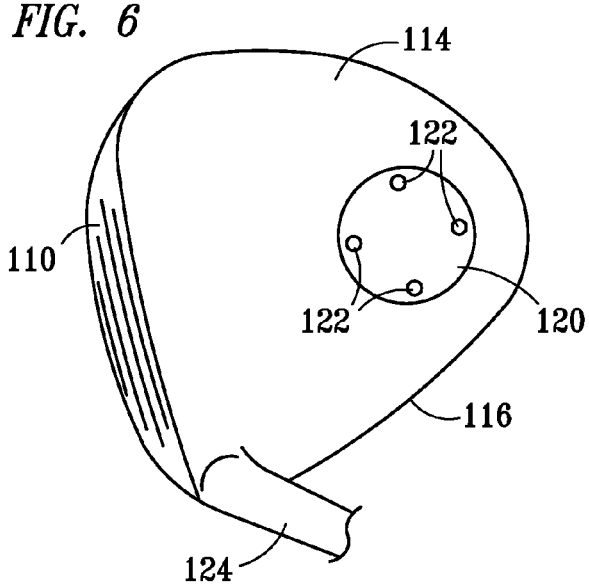
FIG. 6 illustrates a metal driver head embodying features of the present invention.

FIG. 6 illustrates a driver golf club head embodying features of the present invention in which the weighting-port cover 120 is located on the crown portion 114.

Figure 7:
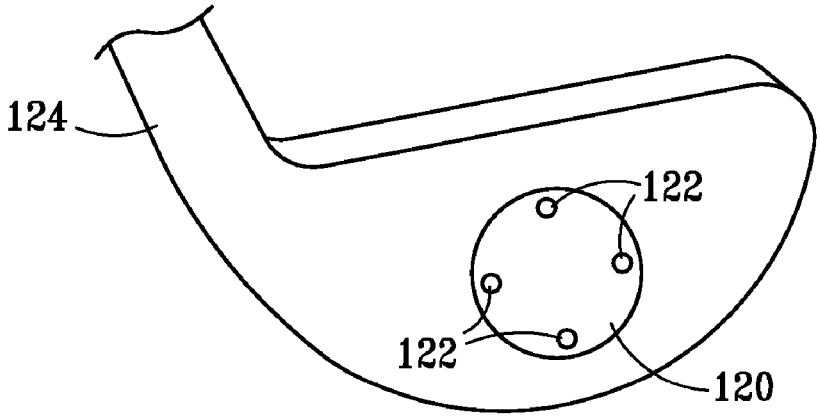
FIG. 7 illustrates a metal iron golf club head embodying features of the present invention.

FIG. 7 illustrates a hollow, iron golf club head embodying features of the present invention in which a weighting-port cover 710 is provided.

Figure 8:
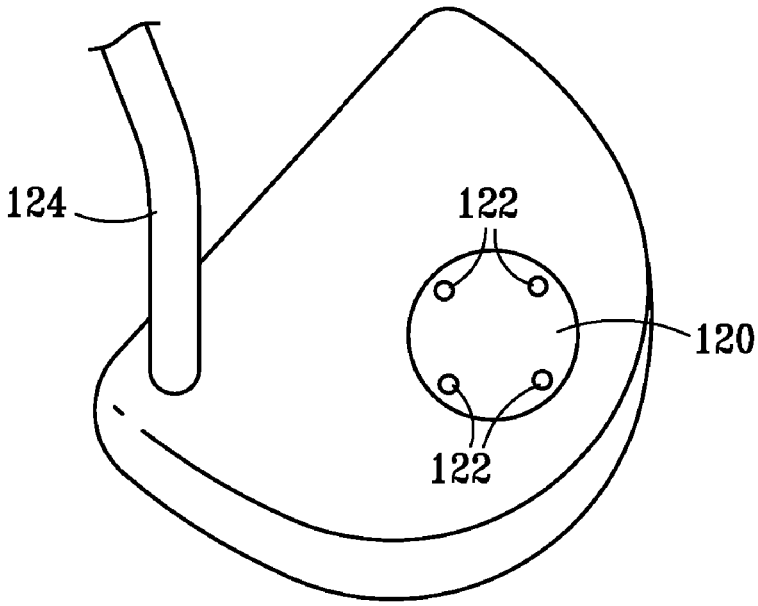
FIG. 8 illustrates a metal putter head embodying features of the present invention.

FIG. 8 illustrates a hollow, putter golf club head embodying features of the present invention in which a weighting-port cover 810 is provided.

Figure 9:
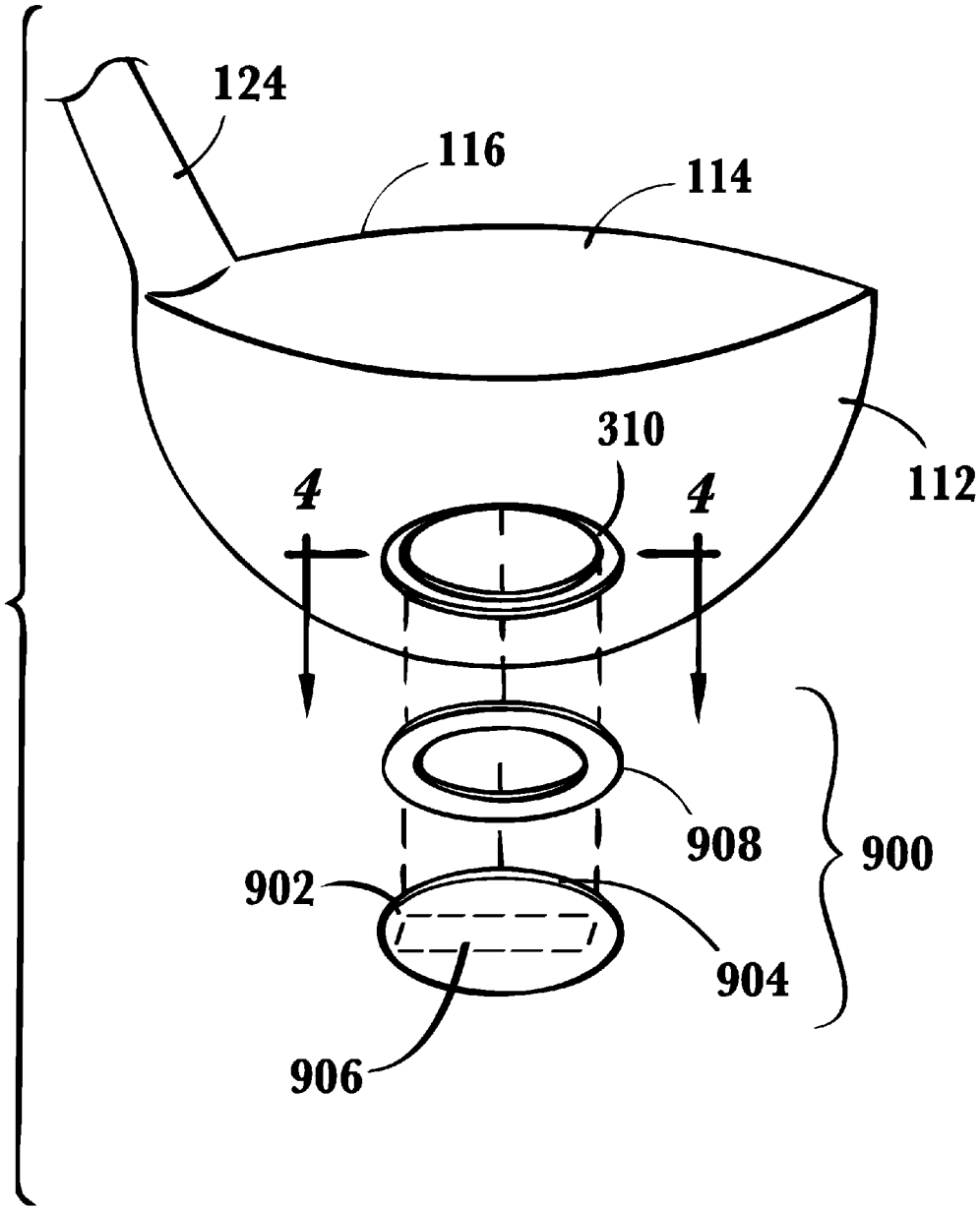
FIG. 9 illustrates an alternative embodiment of a golf club head.

FIG. 9 illustrates an alternative embodiment as described above wherein the weighting-port cover 902 screws into the body. In this embodiment, the cover 902 includes a substantially curved threaded outer perimeter 904. A weight 906 attached to an inner portion of the cover 902 is shown in phantom. Reference numeral 908 is a seal, as has been described. The elements 902, 904, 906 and 908 comprise an assembly.

It should be noted that the placement and size of the weighting port is shown for illustrative purposes only, and, therefore, should not limit the present invention in any manner.

It is understood that the present invention can take many forms and embodiments. Accordingly, several variations may be made in the foregoing without departing from the spirit or the scope of the invention. For example, the weighting port may be of a different shape and/or there may be a different method of accessing the interior of the club head, such as removing the sole of the club head, the back of the club head, or the like.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. Golf club head structure comprising, in combination:

a shell having an integral step portion extending inwardly from an exterior surface of the shell and forming an opening in the shell; and a weight member, comprising:

a cover having a substantially curved perimeter and including a hole therethrough, the cover having an inner portion, and an outer portion;

a weight attached to the inner portion of the cover;

a fastener flush-mounted in the hole in the cover and coupling the cover and the weight to the integral step portion;

the cover outer portion covering the weight and being recessed from the exterior surface of the shell when the fastener couples the cover to the integral step portion;

the weight member sealing the opening when assembled to the shell.

2. The golf club head structure as described in claim 1, further including a hosel portion connected to and integrated with the shell.

3. The golf club head structure as described in claim 2, wherein the fastener extends through the opening and into a hollow cavity inside the shell.

4. The golf club head structure as described in claim 2, wherein the opening and the weight member are located on a bottom portion of the shell.

5. The golf club head structure as described in claim 2, wherein at least a portion of the shell is metal.

6. The golf club head structure as described in claim 5, wherein the shell comprises at least first and second metal pieces that are welded together.

7. The golf club head structure as described in claim 2, wherein the weight member is press-fit into the shell.

8. Golf club head structure comprising, in combination:

a metal shell formed from at least first and second pieces welded together, the shell having an integral step portion extending inwardly from an exterior bottom surface of the shell and forming an opening in the shell, a hosel portion connected to and integrated with the shell; and an assembly, comprising:

a cover having an outer portion and a substantially curved threaded outer perimeter adapted to be received in the opening in the shell;

a weight; and a seal;

the cover outer portion covering the weight and the seal and being at least partially recessed from the exterior surface of the shell when the assembly is threadably coupled to the integral step portion.

9. The golf club head structure as described in claim 8, wherein the seal at least partially extends into the integral step portion and does not extend beyond the exterior bottom surface of the metal shell.

10. The golf club head structure as described in claim 8, wherein the seal also acts as a dampener to reduce vibration when the golf club head strikes a golf ball.

* * * * *